US010730693B1

(12) United States Patent
Ernsberger

(10) Patent No.: US 10,730,693 B1
(45) Date of Patent: Aug. 4, 2020

(54) STORAGE AND DISPENSING BINS FOR FLOWABLE MATERIAL

(71) Applicant: 20/20 Custom Molded Plastics, LLC, Holiday City, OH (US)

(72) Inventor: Ronald Earl Ernsberger, Napoleon, OH (US)

(73) Assignee: 20/20 CUSTOM MOLDED PLASTICS, LLC, Holiday City, OH (US)

( * ) Notice: Subject to any disclaimer, the term of this patent is extended or adjusted under 35 U.S.C. 154(b) by 0 days.

(21) Appl. No.: 16/276,497

(22) Filed: Feb. 14, 2019

(51) Int. Cl.

| | |
|---|---|
| ***B65D 90/00*** | (2006.01) |
| ***B65D 88/30*** | (2006.01) |
| ***B65D 88/28*** | (2006.01) |
| ***B65D 90/58*** | (2006.01) |
| *B65D 83/06* | (2006.01) |

(52) U.S. Cl.
CPC ..... *B65D 88/30* (2013.01); *B65D 88/28* (2013.01); *B65D 90/0033* (2013.01); *B65D 90/587* (2013.01); *B65D 83/06* (2013.01)

(58) Field of Classification Search
CPC .. B65D 88/30; B65D 90/0033; B65D 90/587; B65D 88/28; B65D 83/06
See application file for complete search history.

(56) References Cited

U.S. PATENT DOCUMENTS 3,318,473 A * 5/1967 Jones ..... B65D 88/26 108/55.1
4,742,951 A 5/1988 Kelly et al.
5,226,558 A 7/1993 Whitney et al.
5,232,120 A 8/1993 Dunken et al.
5,287,993 A * 2/1994 Ford ..... A47J 31/404 222/135
5,385,233 A 1/1995 McKibben et al.
5,702,034 A * 12/1997 Semenenko ..... B65D 19/18 222/143
5,829,616 A * 11/1998 Daniel ..... B65D 19/08 220/4.03
6,010,022 A 1/2000 Deaton
7,475,796 B2 * 1/2009 Garton ..... B65D 88/128 211/153
8,757,412 B2 6/2014 Sommer et al.
8,887,914 B2 * 11/2014 Allegretti ..... B65D 19/06 206/386

(Continued)

*Primary Examiner* — David P Angwin
*Assistant Examiner* — Bob Zadeh
(74) *Attorney, Agent, or Firm* — Matthew D. Thayne; Thayne and Davis LLC

(57) ABSTRACT

Bins for storing and/or dispensing a material, such as preferably a flowable material. In some embodiments, the bin may comprise a body comprising an inner storage chamber configured to receive and store a flowable material therein. A forklift base may be coupled to the body and may comprise one or more pairs of forklift slots configured to receive forks of a forklift to allow the storage bin to be lifted and transported. A dispensing gate may be slidably positioned adjacent to a dispensing opening in the body to allow for positioning between a closed configuration in which the flowable material is blocked from being dispensed from the inner storage chamber and an open configuration in which the dispensing gate is moved away from the dispensing opening to allow the flowable material to exit the inner storage chamber.

5 Claims, 4 Drawing Sheets

(56) References Cited

U.S. PATENT DOCUMENTS

| | | | | |
|---|---|---|---|---|
| 9,580,237 | B2 | 2/2017 | Nolan et al. | |
| 2002/0148859 | A1* | 10/2002 | Pigott | B65D 11/10 222/185.1 |
| 2008/0277423 | A1* | 11/2008 | Garton | B29C 41/06 222/185.1 |
| 2009/0050576 | A1* | 2/2009 | Gement | C02F 1/76 210/754 |
| 2011/0011893 | A1* | 1/2011 | Cerny | B65D 88/30 222/185.1 |
| 2012/0273484 | A1* | 11/2012 | Culleton | B65D 88/26 220/4.26 |
| 2019/0112098 | A1* | 4/2019 | Allegretti | B65D 19/06 |

* cited by examiner

STORAGE AND DISPENSING BINS FOR FLOWABLE MATERIAL

SUMMARY

Embodiments of bins for storing and/or dispensing a material are disclosed herein, such as preferably a flowable material, along with implementations of related methods, such as methods for assembly of such bins and/or dispensing of material from such bins.

In a specific example of such a storage bin according to preferred embodiments, the storage bin may comprise a body comprising an inner storage chamber configured to receive and store a flowable material therein. A forklift base may be coupled to the body, in some embodiments, removably coupled, and may comprise a plurality of forklift slots configured to receive forks of a forklift to allow the storage bin to be lifted and transported. The storage bin may further comprise a dispensing opening, which may, in some embodiments, be positioned at a central, lower portion of the body. A dispensing gate may be movably positioned adjacent to the dispensing opening. The dispensing gate may be configured to be movably positioned between a closed configuration in which the flowable material is blocked from being dispensed from the inner storage chamber and an open configuration in which the dispensing gate is moved away from the dispensing opening to allow the flowable material to exit the inner storage chamber, preferably using gravity alone in some embodiments.

Some embodiments may further comprise a dispensing gate slot, which may be positioned in the forklift base and may be configured to slidably receive the dispensing gate therein between the closed configuration and the open configuration.

The forklift base may further comprise an opening positioned along the dispensing gate slot. The opening may be configured to be aligned with the dispensing opening.

The body may be molded or otherwise formed from a thermoplastic material, which may enhance strength and/or improve longevity. In some embodiments, the forklift base may be removably coupled with the body to allow for replacement of worn, damaged, and/or old bases.

In some embodiments, the body may comprise a widened base, which may further improve strength, particularly in regions subject to highest stresses/forces. In some such embodiments, the inner chamber may taper and/or narrow along at least a portion of the widened base.

In some embodiments, the plurality of slots may comprise a first pair of forklift slots and a second pair of slots, both of which may be configured to receive forks of a forklift to allow the storage bin to be lifted and transported. The first pair of forklift slots may be positioned on a first side of the forklift base and the second pair of forklift slots may be positioned on a second side of the forklift base to allow for access by a forklift or other vehicle from multiple sides/portions of the bin. In some embodiments, every side may comprise such forklift slots. Thus, in embodiments comprising a rectangular base, all four sides may comprise a pair of slots or another feature configured to allow a forklift or another vehicle to engage and/or transport the bin.

In another example of a storage bin according to other embodiments, the storage bin may comprise a body defining an inner storage chamber and a dispensing opening configured to allow for dispensing of material, such as a flowable material, from the storage bin. The bin may further comprise a forklift base removably coupleable to the body. The removable forklift base may comprise a plurality of forklift slots, such as one or more pairs of forklift slots, configured to receive forks of a forklift to allow the storage bin to be lifted and transported. The removable forklift base may further comprise a dispensing gate configured to selectively block the dispensing opening to allow for the material to be selectively dispensed therefrom. A dispensing gate slot may be provided, which may be configured to slidably receive the dispensing gate therein.

In some embodiments, the body may comprise a base configured to facilitate removable coupling of the forklift base to the body. For example, in some embodiments, the forklift base may be configured to be received within the base of the body. In some embodiments, fastener openings or other means for facilitating removable coupling between the base and the body may be formed in the base and/or body, such as projections, recesses, prongs, bands, hooks, clasps, and the like.

In some embodiments, the forklift base may further comprise an opening configured to be aligned with the dispensing opening when the forklift base is coupled with the body. In some such embodiments, the opening may be positioned along the dispensing gate slot. In some embodiments, the forklift base may further comprise a second opening, which may be positioned adjacent to the opening. In some such embodiments, the second opening is positioned along the dispensing gate slot, such as preferably at a distal end of the dispensing gate slot, which may inhibit blockage of the dispensing gate slot by the material.

In another example of a storage bin for storing and dispensing a flowable material according to other embodiments, the bin may comprise a body defining an inner storage chamber. The inner storage chamber may comprise a cylindrical portion and a tapering portion terminating in a dispensing opening. The body may comprise a widened base, which may at least partially coincide and/or overlap with the tapering portion. The bin may further comprise a base, such as a forklift base, that may be removably coupled to the body. The base may comprise a first side comprising means for facilitating engagement with a transportation vehicle, such as a first pair of forklift slots configured to receive forks of a forklift, to allow the storage bin to be lifted and transported. The base may further comprise a second side also comprising means for facilitating engagement with a transportation vehicle, such as a second pair of forklift slots configured to receive forks of a forklift to allow the storage bin to be lifted and transported. The base may further comprise a dispensing gate slot positioned adjacent to the dispensing opening and a dispensing gate slidably positioned in the dispensing gate slot and configured to selectively block the dispensing opening to allow for a flowable material to be selectively dispensed therefrom by sliding the dispensing gate away from the dispensing opening.

In some embodiments, the dispensing gate may further comprise an elongated slit, configured to receive a projecting member extending from the dispensing gate slot, or vice versa. In some such embodiments, the projecting member may comprise a pin configured to be slidably positioned within the elongated slit such that the dispensing gate is locked in place within the dispensing gate slot and is limited in travel by the length of the elongated slit.

In some embodiments, the dispensing gate slot may be positioned in between and parallel to, or at least substantially parallel to, the first pair of forklift slots.

The features, structures, steps, or characteristics disclosed herein in connection with one embodiment may be combined in any suitable manner in one or more alternative embodiments.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1:
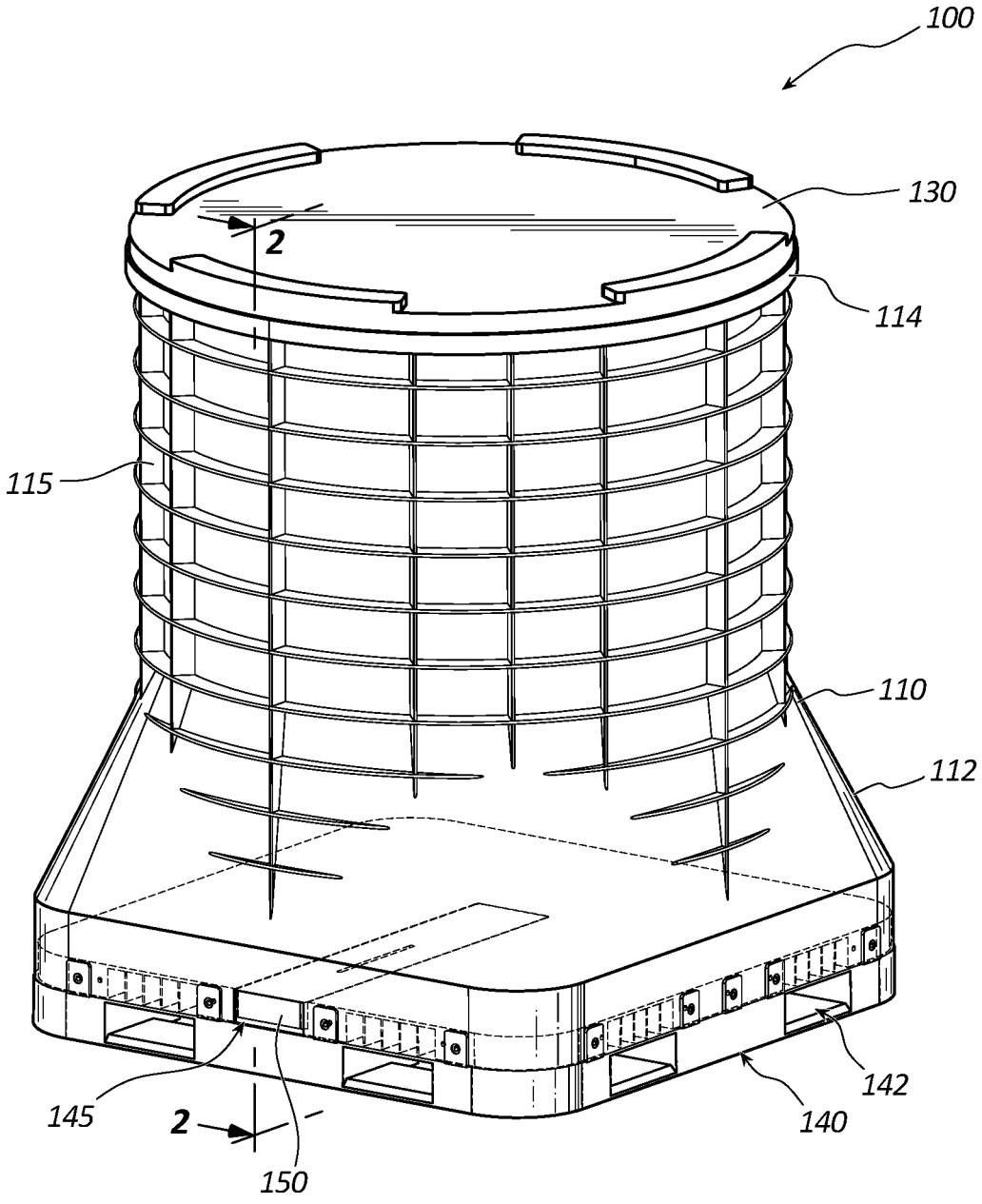
FIG. 1 is a perspective view of a bin for storing and dispensing a flowable material according to some embodiments.

It will be readily understood that the components of the present disclosure, as generally described and illustrated in the drawings herein, could be arranged and designed in a wide variety of different configurations. Thus, the following more detailed description of the embodiments of the apparatus is not intended to limit the scope of the disclosure, but is merely representative of possible embodiments of the disclosure. In some cases, well-known structures, materials, or operations are not shown or described in detail.

As used herein, the term "substantially" refers to the complete or nearly complete extent or degree of an action, characteristic, property, state, structure, item, or result to function as indicated. For example, an object that is "substantially" cylindrical or "substantially" perpendicular would mean that the object/feature is either cylindrical/perpendicular or nearly cylindrical/perpendicular so as to result in the same or nearly the same function. The exact allowable degree of deviation provided by this term may depend on the specific context. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

Similarly, as used herein, the term "about" is used to provide flexibility to a numerical range endpoint by providing that a given value may be "a little above" or "a little below" the endpoint while still accomplishing the function associated with the range.

The embodiments of the disclosure may be best understood by reference to the drawings, wherein like parts may be designated by like numerals. It will be readily understood that the components of the disclosed embodiments, as generally described and illustrated in the figures herein, could be arranged and designed in a wide variety of different configurations. Thus, the following detailed description of the embodiments of the apparatus and methods of the disclosure is not intended to limit the scope of the disclosure, as claimed, but is merely representative of possible embodiments of the disclosure. In addition, the steps of a method do not necessarily need to be executed in any specific order, or even sequentially, nor need the steps be executed only once, unless otherwise specified. Additional details regarding certain preferred embodiments and implementations will now be described in greater detail with reference to the accompanying drawings.

FIG. 1 is a perspective view of a storage bin 100 according to some embodiments for storing and dispensing a flowable material, such as, for example, a liquid or a granular material, such as seeds, pellets, marbles or other spherical objects, and the like. Storage bin 100 comprises a body 110 that may define an inner storage chamber 120 (see FIG. 2) configured to receive and store a flowable material. Body 110 preferably comprises a widened base 112, which may be reinforced with additional material to account for the higher forces typically associated with the stored material within inner storage chamber 120.

To further enhance strength and/or decrease unnecessary weight, various other features may be provided, such as external ribs 115 and/or various voided regions, as discussed below. In the depicted embodiment, ribs 115 comprise cross-ribs including ribs extending vertically and ribs extending horizontally to provide increased strength.

To a similar end, certain preferred embodiments may comprise a body 110 that is molded or otherwise formed from a suitable thermoplastic material. In preferred embodiments, the body 110 may be molded, such as injection-molded, and may comprise, for example, a high-density polyethylene, a homopolymer polypropylene, or another suitable polyethylene or polypropylene. Providing a one-piece, unitary construction for the portion used to store the material, such as body 110 in the depicted embodiment, may be preferred as various known storage bins provide a multi-piece construction that provides several potential points of failure that may unduly limit the weight of the contents within.

Certain preferred embodiments further comprise a cylindrical shape for at least a portion of the exterior of body 110 and/or the inner storage chamber 120. For example, in the depicted embodiment, inner storage chamber 120 comprises a cylindrical shape along the top portion. A funnel-shaped, tapering, and/or narrowing portion 122 may be provided in the bottom portion of inner storage chamber 120 to facilitate dispensing of the material being stored therein, as discussed in greater detail below. Tapering portion 122 may terminate in a dispensing opening 124, which may again comprise a cylindrical shape. In addition, aside from widened base 112, which defines a rectangular shape, the exterior of body 110 also comprises a circular/cylindrical shape. Of course, the tapering portion 122 may vary or be omitted as desired.

Figure 5:
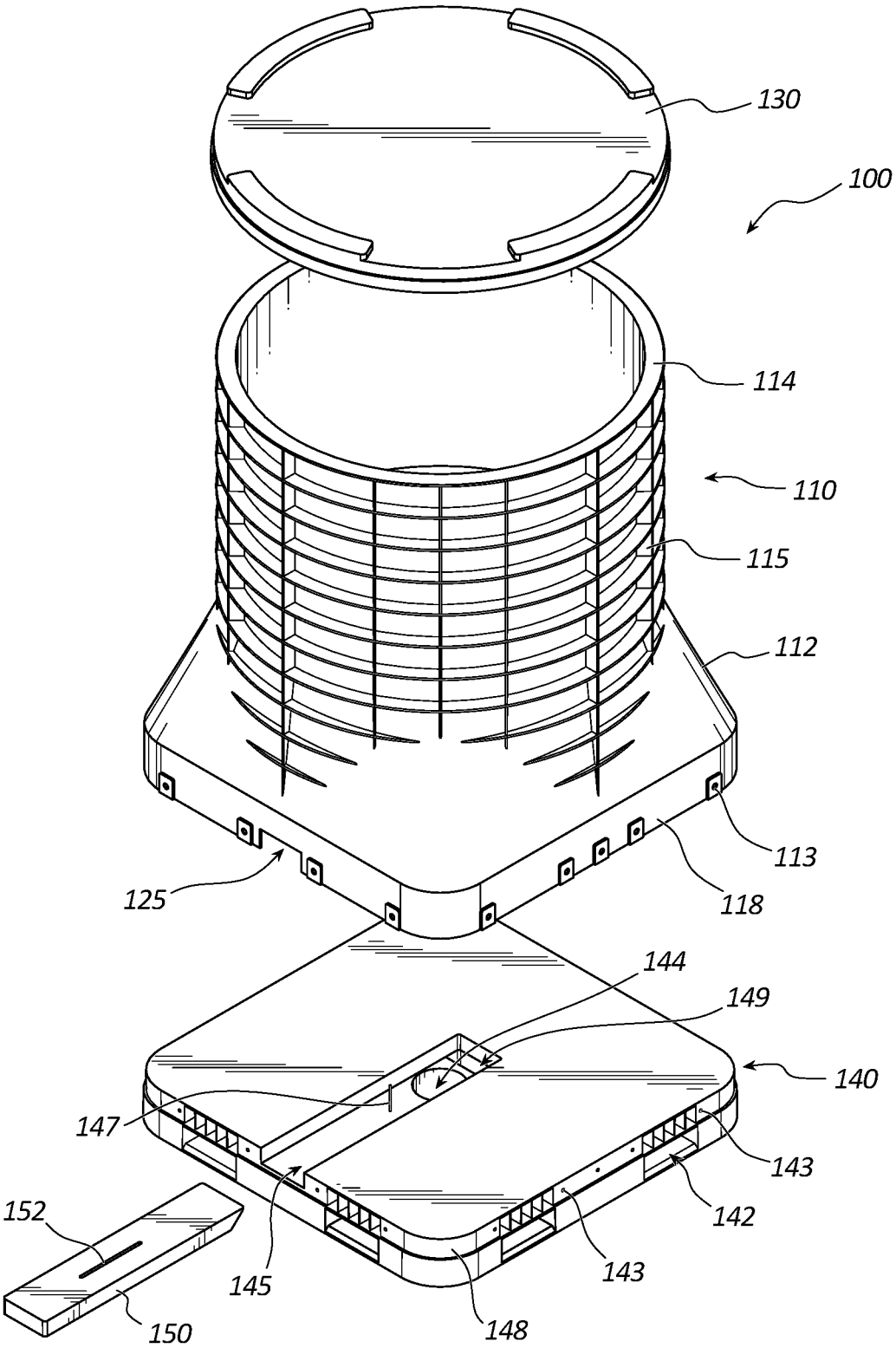
FIG. 5 is an exploded view of the storage bin showing the removable forklift base removed from the body and a sliding dispensing gate removed from the forklift base.

In some embodiments, storage bin 100 may further comprise a lid 130, which may be coupleable (in some embodiments, lockably coupleable) with rim 114 of body 110. Some such embodiments may comprise a flange that extends over rim 114, as best seen in the exploded view of FIG. 5. In some embodiments, lid 122 may comprise one or more openings, which openings may be permanently open or selectively closeable. Such openings may allow for ventilation between the inside of bin 100 and the surrounding atmosphere.

Although it may be desired to provide a unibody construction for the portion of storage bin 100 defining inner chamber 120, it may be desired to provide a coupleable base portion that may be used for a variety of purposes, such as providing for a means for allowing a forklift or another transportation means to move storage bin 100. This is because these portions of a storage bin are often damaged and can be difficult to repair. Thus, in certain preferred embodiments of the inventions disclosed herein, including the embodiment depicted in the accompanying figures, a base 140 may be configured to be removably coupled to the widened base 112 of body 110. In this manner, damage from transporting storage bin 100 may be handled by simply removing the damaged and/or old base 140 and replacing it with a new base 140. As shown in the figures, base 140 and/or body 110 may comprise a plurality of fastener openings, which may be aligned with one another to allow the two pieces to be secured together and, if desired, removed to allow for the replacement previously mentioned. More particularly, body 110 comprises fastener openings 113 and base comprises fastener openings 143. Upon coupling base 140 with body 110, fastener opening 113 are aligned with fastener openings 143 to facilitate providing a more secure coupling between these two elements.

In the depicted embodiment, body 110 comprises a flange or skirt 118 extending about the perimeter of the bottom of widened base 112 and base 140 comprises an upper portion or upper deck 148 defining a ridge extending about the perimeter of base 140. Preferably the perimeter defined by skirt 118 is slightly larger than the perimeter defined by upper deck 148 but slightly smaller than the perimeter defined by the lower deck or ridge so that upper deck 148 can be received into skirt 118 and fastener openings 113/143 aligned and fasteners (not shown), such as bolts, screws, rivets, or the like, may be used to secure base 140 to body 110, as shown in FIG. 1. Skirt 118 may further comprise a notch 125 that may be configured to be aligned with a dispensing gate slot 145, which is discussed in greater detail below, to allow for removal of a dispensing gate 150 therefrom for selective dispensing of the flowable or other material stored in chamber 120.

In preferred embodiments, including the depicted embodiment, base 140 comprises a plurality a plurality of forklift slots 142 configured to receive forks of a forklift to allow storage bin 100 to be lifted and transported. Base 140 may therefore, at least with respect to such embodiments, be considered a "forklift base." Preferably, forklift slots 142 are provided in pairs to receive the opposing forks of a typical forklift. In addition, preferably slots 142 are provided in pairs along more than one (most preferably along each) side of bin 100 to provide added convenience by allowing bin 100 to be lifted and transported along any of its sides. However, it is contemplated that, in alternative embodiments, other means for facilitating transportation of storage bin 100 may be provided, such as a single slot for receiving a single lift platform of an alternative vehicle. In addition, although the slots 142 of the depicted embodiment are formed as openings that extend around an entire circumference, it is also contemplated that, in other alternative embodiments, slots 142 may only be defined by three (or less) sides. For example, one or more slots 142 may have an open lower portion and/or be formed along the bottom of base 140 by forming a recessed area not defined by a bottom surface.

Figure 2:
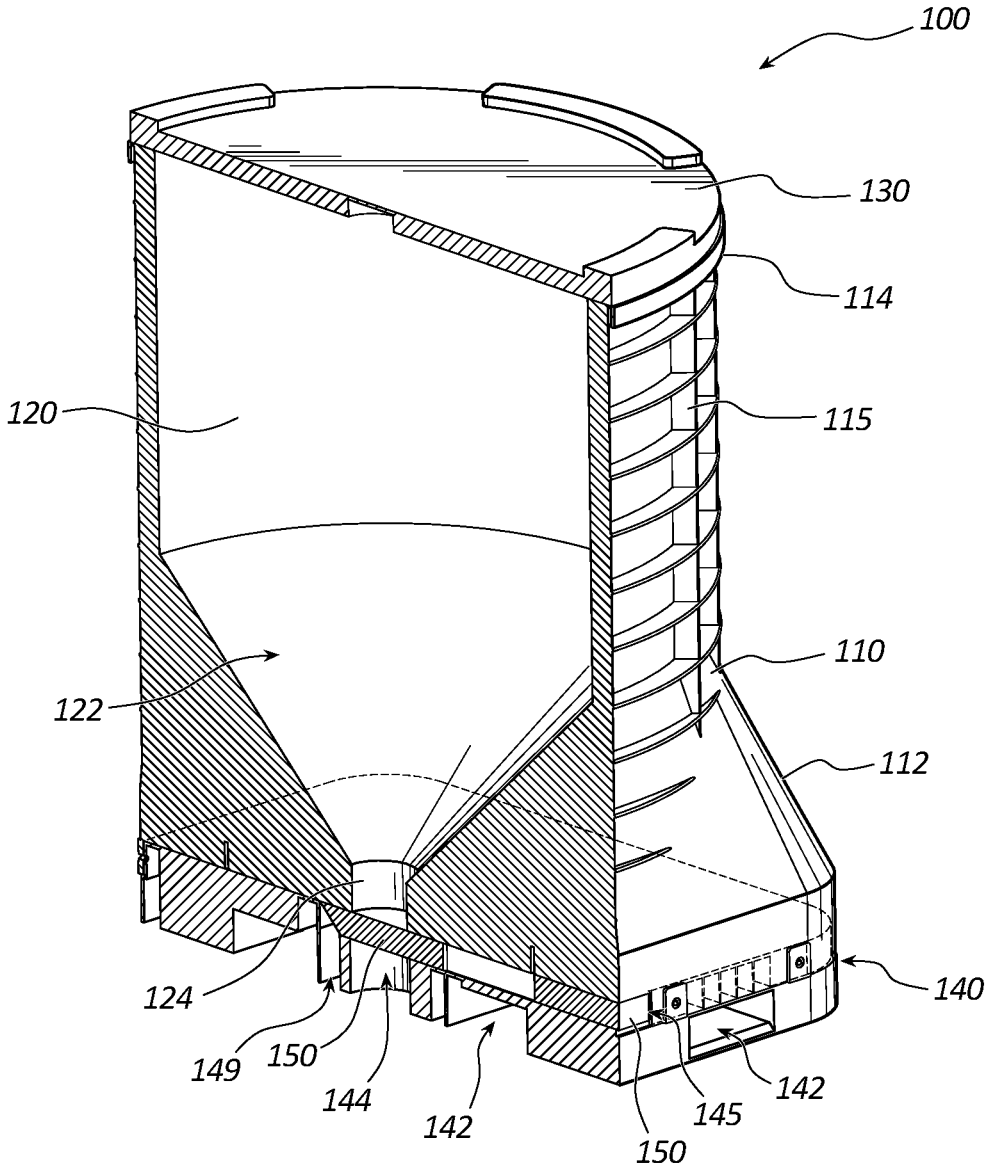
FIG. 2 is a cross-sectional view taken along line 2-2 in FIG. 1.

As depicted in several of the accompanying figures, including the cross-sectional view of FIG. 2, base 140 may further comprise a dispensing opening 144, which is preferably positioned so as to be aligned, at least partially (fully in the depicted embodiment) with dispensing opening 124 of base 112.

A dispensing gate slot 145 may be formed within base 140 and may be configured to receive a dispensing gate 150 therein. Dispensing gate 150 is preferably slidably or otherwise movably received within dispensing gate slot 145 adjacent to dispensing openings 124 and 144 between a closed configuration (as depicted in FIG. 2) in which the flowable material within storage chamber 120 is blocked from being dispensed therefrom and an open configuration in which dispensing gate 150 is moved away from the dispensing opening defined by dispensing openings 124 and 144 to allow the flowable material to exit the storage chamber 120 and ultimately exit storage bin 100 via opening 144.

Figure 3:
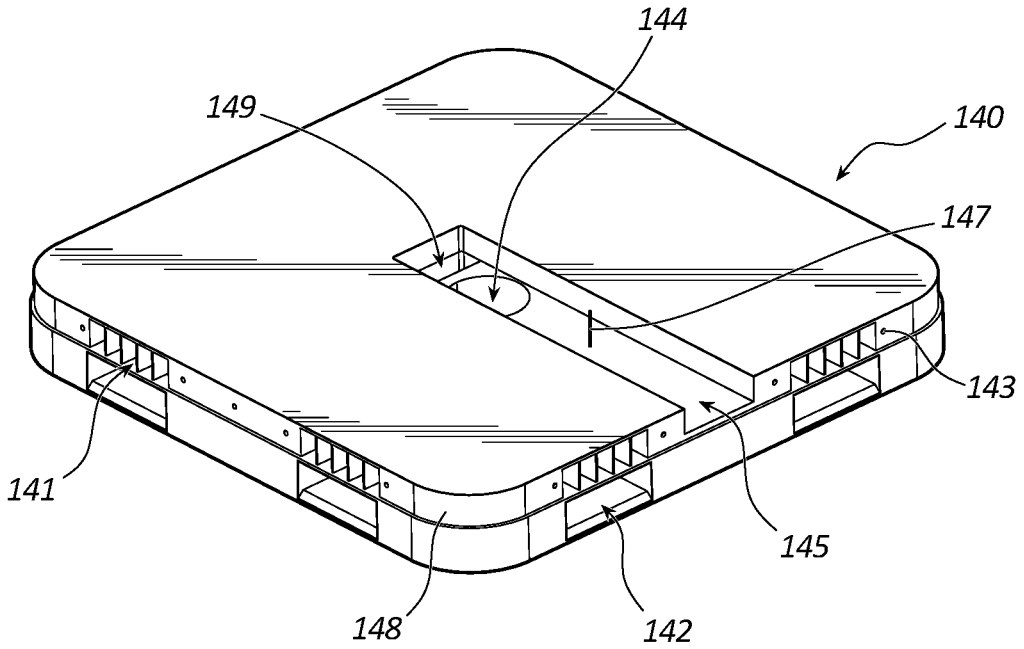
FIG. 3 is an upper perspective view of a removable forklift base for coupling with a body of a storage bin according to some embodiments.
Figure 4:
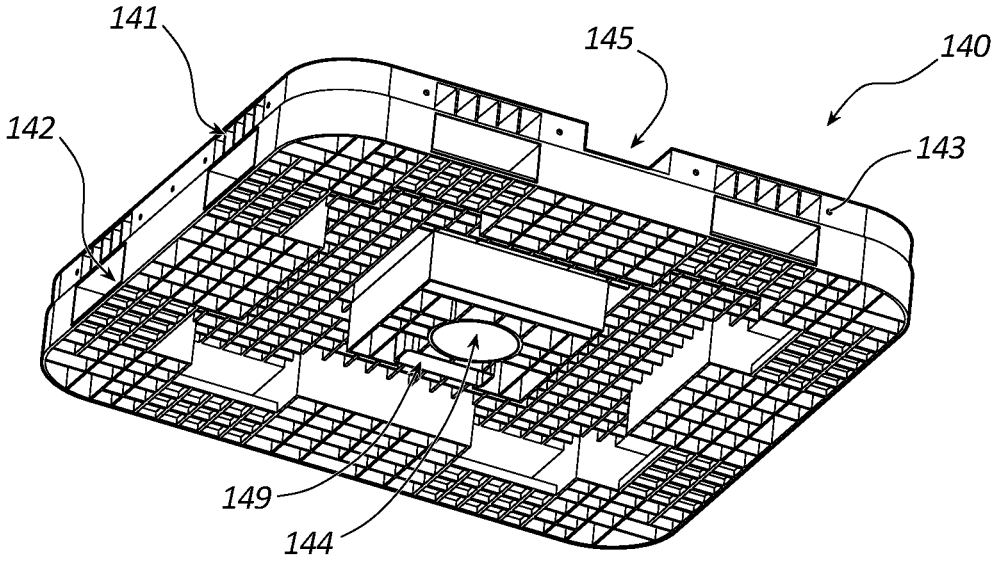
FIG. 4 is a lower perspective view of the removable forklift base of FIG. 3.

As best illustrated in FIGS. 3 and 4, in some embodiments, dispensing gate slot 145 is positioned in between and parallel to, or at least substantially parallel to, at least one pair of forklift slots 142.

In some embodiments, dispensing gate 150 is positioned within dispensing gate slot 145 in a manner to prevent, or at least inhibit, dispensing gate 150 from being fully removed from dispensing gate slot 145. Thus, in the depicted embodiment, dispensing gate 150 comprises an elongated slit 152 (see FIG. 5) and base 140 comprises a pin 147 or another suitable projecting member that is configured to be slidably positioned within slit 152. In this manner, dispensing gate 150 may be locked in place within dispensing gate slot 145 and may be limited in travel by the length of the slit 152. In some embodiments, slit 152 may alternatively, or additionally, be used as a means to engage dispensing gate 150 to allow dispensing gate 150 to be moved between its open and closed configurations. In alternative embodiments, slit 152 may be omitted and/or another means for engaging gate 150 to facilitate such movement, such as a handle that may be formed on or otherwise coupled with the exterior surface of gate 150, may be provided.

As shown in the drawings, some embodiments may comprise a gate 150 comprising an angled distal end. This feature may improve the ability to inhibit the material being stored and dispensed from bin 100 from being trapped within the dispensing gate slot 145 during dispensing. More particularly, in the depicted embodiment, gate 150 comprises a distal end that tapers from a longer top surface to a shorter bottom surface, which may improve the ability of gate 150 to "wipe" or otherwise advance excess material towards a dispensing opening, such as opening 144.

To further facilitate cleaning, clogging, losing stored material, and/or the like, some embodiments may further comprise one or more auxiliary openings. To illustrate with one example, forklift base 140 of bin 100 comprises a second or auxiliary opening 149, which is positioned adjacent to opening 144, as best seen in the cross-sectional view of FIG. 2. Auxiliary opening 149, like opening 144, is positioned along dispensing gate slot 145, as best shown in FIG. 3. By providing a second opening such as opening 149, if material from chamber 120 is to only be partial dispensed, such that dispensing gate 150 must be opened and then reclosed without entirely evacuating the contents of chamber 120, any excess material that might otherwise be trapped between gate 150 and the slot 145, and may also prevent gate 150 from being fully closed, may simply be expelled via auxiliary opening 149. Preferably, auxiliary opening 149 is at, coincident with, or at least substantially coincident with, the distal end of slot 145 so as to avoid providing an enclosed space for extraneous material to be trapped. It may also be preferred to have the auxiliary opening 149 be in close proximity to the primary dispensing opening 144 of base 140, as is the case with the depicted embodiment, to allow for a single opening of a portable container, or another container or other object into which the material is to be dispensed, to be used to receive material from both openings simultaneously.

In some embodiments, additional features may be added to reduce weight, enhance strength, and/or improve specific strength, strength to weight ratio, and/or the like. For example, the depicted embodiment further comprises a plurality of voided regions 141 along the bottom and sides of base 140, as best seen in FIG. 4, which may be formed by parallel bars/members, in some cases comprising cross-bars/member. The voided regions 141 along the sides are formed in upper deck 148 and may be covered upon coupling of base 140 with body 110 by skirt 118, as shown by the phantom lines of FIG. 2.

It will be understood by those having skill in the art that changes may be made to the details of the above-described embodiments without departing from the underlying principles presented herein. In addition, any suitable combination of various embodiments, or the features thereof, is contemplated.

Any methods disclosed herein may comprise one or more steps or actions for performing the described method. The method steps and/or actions may be interchanged with one another. In other words, unless a specific order of steps or actions is required for proper operation of the embodiment and/or implementation, the order and/or use of specific steps and/or actions may be modified.

Throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, inventive aspects lie in a combination of fewer than all features of any single foregoing disclosed embodiment.

Those having skill in the art will therefore appreciate that many changes may be made to the details of the above-described embodiments without departing from the underlying principles of the invention. The scope of the present invention should, therefore, be determined only by the following claims.

The invention claimed is:

1. A storage bin for storing and dispensing a flowable material, comprising:

a body defining an inner storage chamber, wherein the inner storage chamber comprises a cylindrical portion and a tapering portion terminating in a dispensing opening, wherein the body comprises a widened base, and wherein the widened base at least partially coincides with the tapering portion;

a forklift base removably coupled to the body, wherein the forklift base comprises:

a first side comprising a first pair of forklift slots configured to receive forks of a forklift to allow the storage bin to be lifted and transported;

a second side comprising a second pair of forklift slots configured to receive forks of a forklift to allow the storage bin to be lifted and transported;

a dispensing gate slot positioned adjacent to the dispensing opening; and a dispensing gate slidably positioned in the dispensing gate slot and configured to selectively block the dispensing opening to allow for a flowable material to be selectively dispensed therefrom by sliding the dispensing gate away from the dispensing opening, wherein the dispensing gate further comprises an elongated slit, and wherein the forklift base comprises a projecting member configured to be positioned within the elongated slit.

2. The storage bin of claim 1, wherein the projecting member comprises a pin configured to be slidably positioned within the elongated slit such that the dispensing gate is locked in place within the dispensing gate slot and is limited in travel by the length of the elongated slit.

3. The storage bin of claim 1, wherein the dispensing gate slot is positioned in between and at least substantially parallel to the first pair of forklift slots.

4. The storage bin of claim 1, wherein the forklift base further comprises:

a third side comprising a third pair of forklift slots configured to receive forks of a forklift to allow the storage bin to be lifted and transported; and a fourth side comprising a fourth pair of forklift slots configured to receive forks of a forklift to allow the storage bin to be lifted and transported.

5. The storage bin of claim 1, wherein the body comprises a one-piece, unitary body.

* * * * *